US008333019B2

(12) United States Patent
Gossel et al.

(10) Patent No.: US 8,333,019 B2
(45) Date of Patent: Dec. 18, 2012

(54) LAUNDRY DRYER HAVING AN AIR DUCT

(75) Inventors: Thomas Gossel, Juelich (DE); Christian Maiss, Herzogenrath (DE)

(73) Assignee: Miele & Cie. KG, Guetersloh (DE)

( * ) Notice: Subject to any disclaimer, the term of this patent is extended or adjusted under 35 U.S.C. 154(b) by 553 days.

(21) Appl. No.: 12/115,882

(22) Filed: May 6, 2008

(65) Prior Publication Data

US 2008/0276478 A1 Nov. 13, 2008

(30) Foreign Application Priority Data

May 7, 2007 (DE) ..... 10 2007 021 815

(51) Int. Cl.
*F26B 11/02* (2006.01)
*F26B 21/00* (2006.01)

(52) U.S. Cl. ..... 34/604; 34/605; 34/140; 34/227; 34/235

(58) Field of Classification Search ..... 34/72, 76, 34/604, 227, 231, 605, 140, 235; 415/205, 415/208.1, 206; 454/189
See application file for complete search history.

(56) References Cited

U.S. PATENT DOCUMENTS 2,561,840 A * 7/1951 Busquet ..... 415/161
2,690,294 A * 9/1954 Cary ..... 417/423.15
2,817,281 A * 12/1957 Schwan et al. ..... 454/189
3,196,250 A * 7/1965 Umann ..... 392/379
3,286,363 A * 11/1966 Grimshaw ..... 34/546
5,915,922 A 6/1999 Wiethe et al.
2001/0018023 A1* 8/2001 Tagomori et al. ..... 415/220
2005/0217139 A1* 10/2005 Hong ..... 34/604
2007/0217906 A1* 9/2007 Smiley et al. ..... 415/200

FOREIGN PATENT DOCUMENTS

| | | |
|---|---|---|
| DE | 8904738 | 5/1989 |
| DE | 19644711 | 4/1998 |
| DE | 19839729 | 12/1999 |
| EP | 0702105 | 3/1996 |
| EP | 1285987 | 2/2003 |
| EP | 1524360 | 4/2005 |
| EP | 1584733 | 10/2005 |
| EP | 1865103 | 12/2007 |
| GB | 2219849 | 12/1989 |

OTHER PUBLICATIONS

Prospect Miele "Elektrogeraete fuer den Haushalt and Kleingewerbe", Programm-Uebersicht / Fachhandel, Jan. 1, 2006, Softtronic T 4462 C, p. 47.

* cited by examiner

*Primary Examiner* — Jiping Lu
(74) *Attorney, Agent, or Firm* — Leydig, Voit & Mayer, Ltd.

(57) ABSTRACT

A laundry dryer with a blower and an air duct configured to convey a flow of air toward the blower. The air duct includes one or more flow chambers with curved sections. The curved sections are configured to deflect the flow of air toward the blower. The laundry dryer also includes a displacement member disposed in the flow chamber in front of the blower and configured to produce an irrotational flow onto a wheel of the blower so as to reduce a formation of vortices.

6 Claims, 3 Drawing Sheets

LAUNDRY DRYER HAVING AN AIR DUCT

CROSS REFERENCE TO RELATED APPLICATIONS

Priority is claimed to German patent application DE 10 2007 021 815.1, filed May 7, 2007, which is hereby incorporated by reference herein.

FIELD

The present invention relates to a laundry dryer having an air duct for conveying a flow of air toward a blower, the air duct is formed with at least one flow chamber which has curved sections and in which the air flow is deflected toward the blower.

BACKGROUND

One example of a laundry dryer of this type is, for example, the Miele model T 4462 C. This laundry dryer is provided with noise-reducing means in the area of the air ducts and the heat exchanger, said noise-reducing means significantly reducing the operating noise of the laundry dryer. However, further measures for noise reduction are necessary in the region of the flow-diverting sections of the air duct.

EP 0 702 105 B1 describes providing the blower housing with an air inlet partly covering the blower wheel on the air intake side and with a funnel-like insert in which means for noise reduction may be incorporated. This permits adaptation to different configurations of the air passageway, but the optimization of the entire blower in terms of blower output and sound emission requires considerable assembly effort.

DE 89 04 738 U1 describes providing a deflector having guide vanes in front of the intake opening of a blower to cause the aspirated air flow to rotate helically. Noise may be produced at the deflector itself due to air turbulence, so that noise reduction can only be achieved within a limited range of flow intensity.

DE 196 44 711 A1 describes providing flow-guide members in a curved gas duct so as to spread or distribute the air flow to the individual process air ducts in the heat exchanger.

SUMMARY

In view of the above, in an embodiment, an aspect of the present invention is to provide a noise reduction measure in a laundry dryer in the region of flow-diverting duct sections with relatively low assembly effort.

In an embodiment, the present invention provides a laundry dryer with a blower and an air duct configured to convey a flow of air toward the blower. The air duct includes one or more flow chambers with curved sections. The curved sections are configured to deflect the flow of air toward the blower. The laundry dryer includes a displacement member disposed in the flow chamber in front of the blower and configured to produce an irrotational flow onto a wheel of the blower so as to reduce a formation of vortices

BRIEF DESCRIPTION OF THE DRAWINGS

An exemplary embodiment of the present invention is shown in the drawings in a purely schematic way, in which.

DETAILED DESCRIPTION

The present invention provides a velocity field of the air flow in the deflection region, e.g., in the curved flow chamber in front of the blower, that is more uniform due to a displacement member. The resulting irrotational flow onto the blower wheel reduces the formation of vortices, which leads to a more uniform flow distribution over the entire face area. This uniform flow distribution results in a significant noise reduction while permitting an increased volume flow.

In an embodiment, the displacement member may be disposed on the axis of the blower.

In another embodiment of the present invention, depending on the configuration of the flow chamber in front of the blower, the displacement member may be disposed on an axis parallel to the blower axis.

In an embodiment, the displacement member may be rotationally symmetric. For example, the displacement member may be spherical in shape.

In another embodiment of the invention, the displacement member is formed with a cylindrical section and/or a conical section.

The displacement member may also be formed from the wall section of the flow chamber, i.e., to be formed integrally therewith, in an embodiment of the invention. In a further embodiment, the displacement member may be provided as a separate component in the flow chamber.

In any case, the shape and position of the displacement member may be optimized according to the geometries of the air duct and the flow chamber in front of the blower and according to the volume flow rate by means of a series of experiments.

Figure 1:
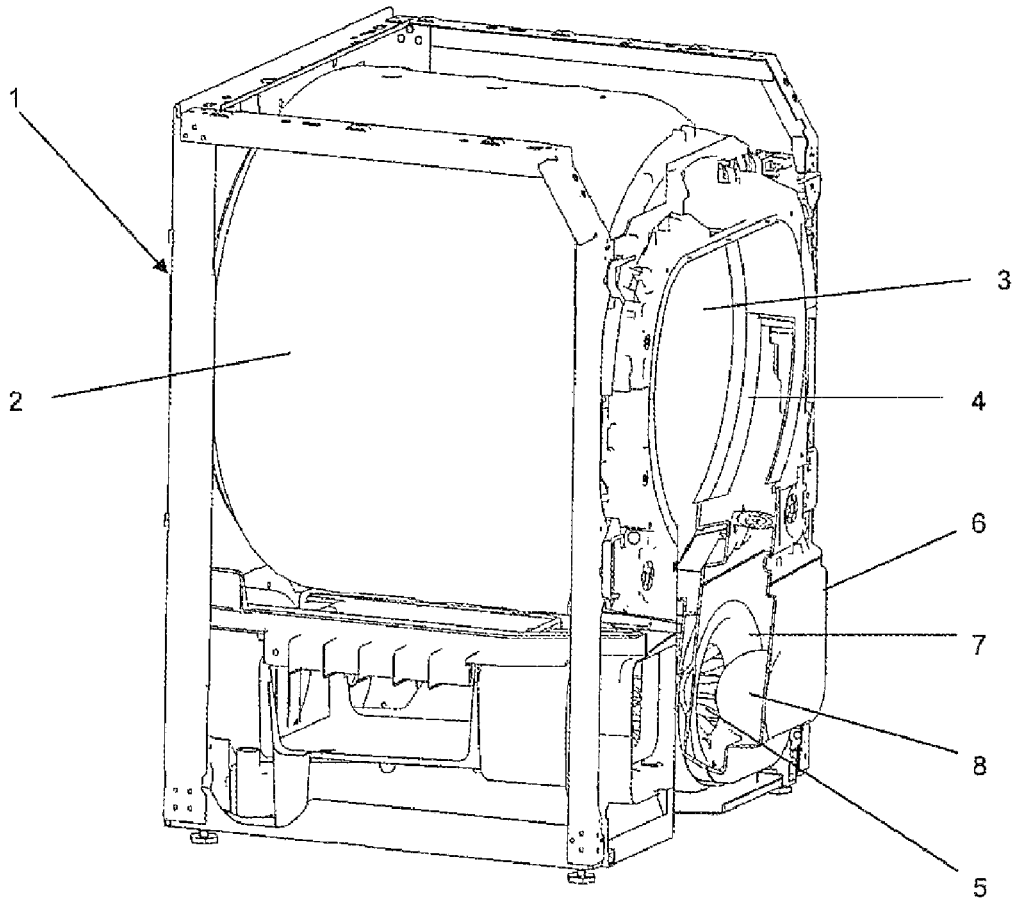
FIG. 1 is a perspective view of a laundry dryer in accordance with an embodiment of the invention.

FIG. 1 illustrates a laundry dryer 1 having a rotatably mounted drum 2. Loading opening 3 of drum 2 is closed by a door which is not shown here. Loading opening 3 is surrounded by a functional component 4 containing the front air passage from drum 2 toward blower 5. In the region below loading opening 3, functional component 4 is designed as an air duct 6 (shown partly in section) for the air flow emerging from drum 2. Flow chamber 7 in front of blower 5 and the displacement member 8 disposed therein can be seen in the partially cross-sectional view of air duct 6. The flow chamber, in which the air flow is deflected toward blower 5, has curved sections.

Figure 2:
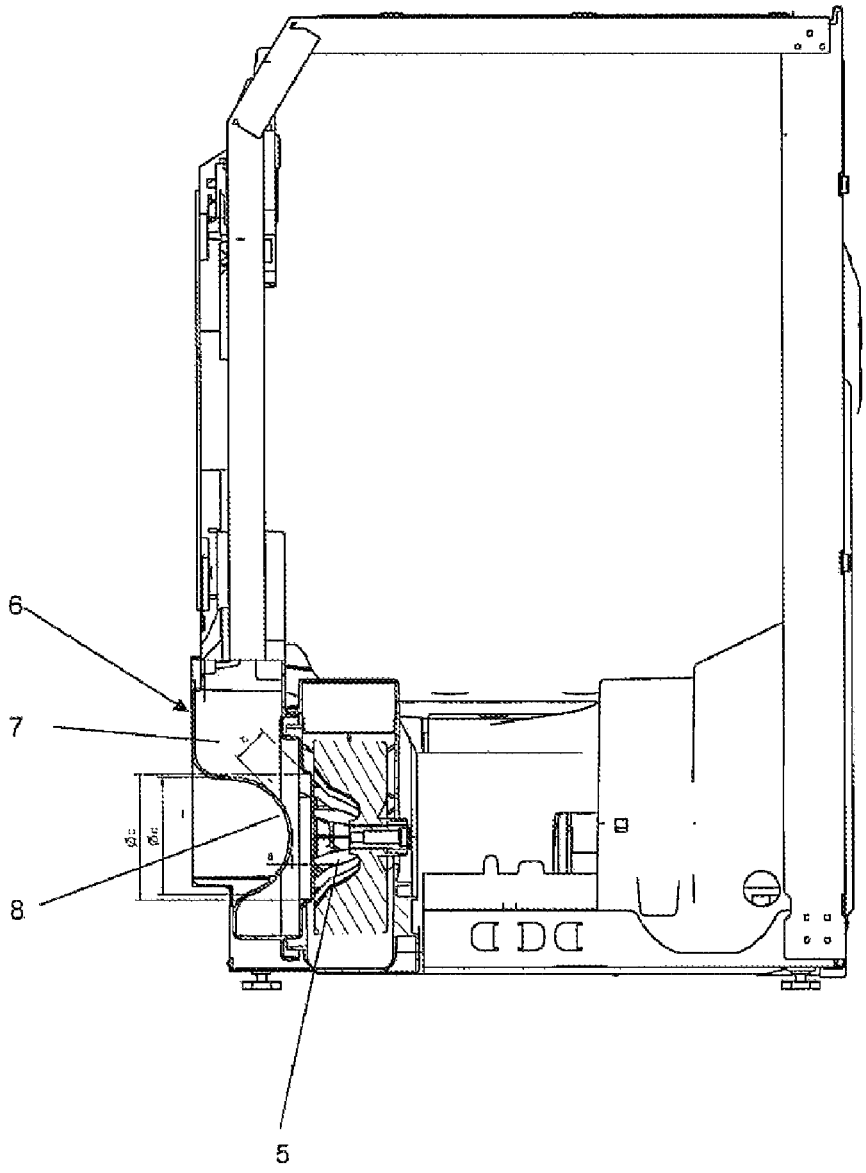
FIG. 2 is a cross-sectional side view of the laundry dryer shown in FIG. 1.

FIG. 2 shows, in a cross-sectional view, air duct 6 and flow chamber 7 in front of blower 5 along with displacement member 8 disposed therein.

Figure 3:
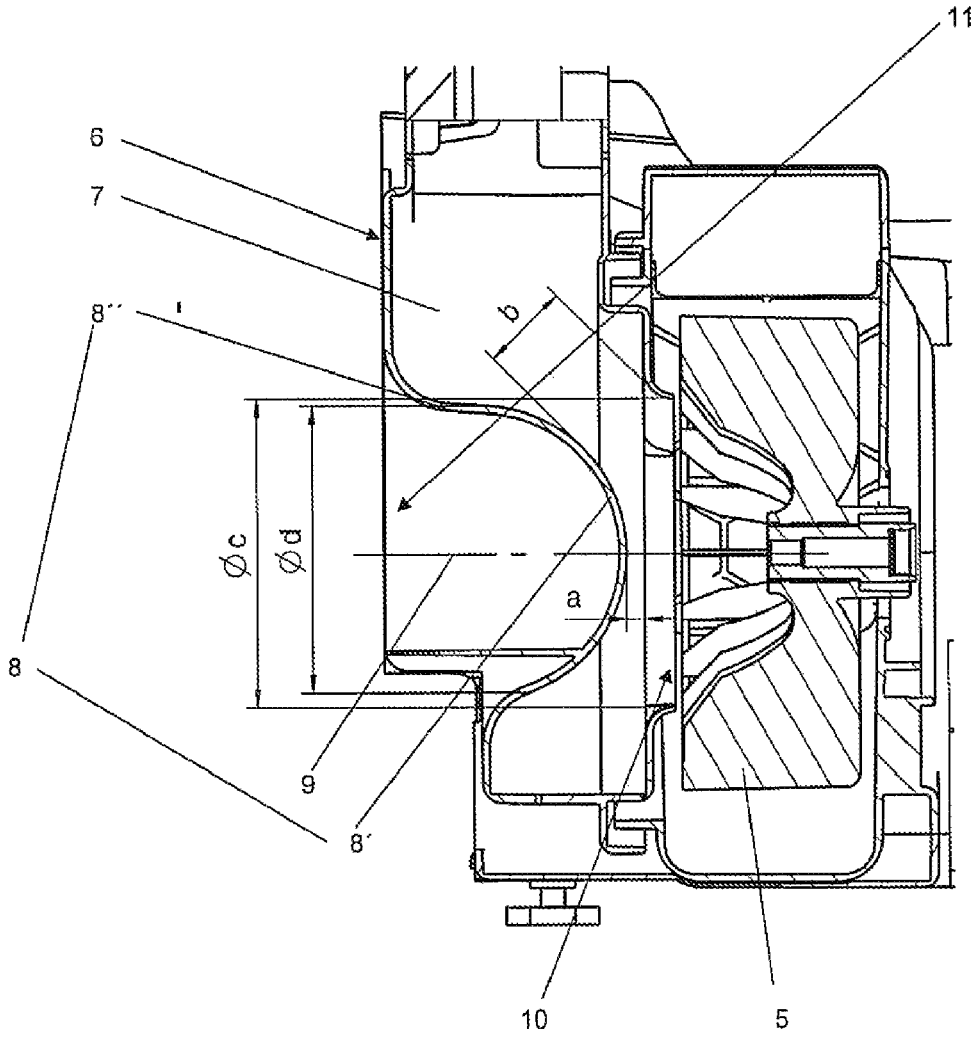
FIG. 3 is a cross-sectional side view showing the flow chamber in front of the blower shown in FIG. 2 in enlarged detail.

In FIG. 3, details of the invention are shown in an enlarged view. In the embodiment shown here, displacement member 8 is positioned on blower axis 9 and has a rotationally symmetric shape. Displacement member 8 has a spherical section 8 directed toward face area 10 of blower 5.

Moreover, displacement member 8 is formed from wall section 11 of air duct 6, i.e., of flow chamber 7, and is integrally connected therewith. Accordingly, in this embodiment, displacement member 8 is an integral part of air duct 6. Depending on the geometry of air duct 6, displacement member 8 is formed with a nearly cylindrical section 8 in the region where it merges into wall section 11 of air duct 6 and has a spherical section 8 adjacent to the aforesaid nearly cylindrical section 8.

In another embodiment of the present invention, the displacement member is formed with a conical section.

In yet another embodiment of the invention, the displacement member is formed as a separate component and secured in the air duct by a suitable joining technique (adhesive bonding, welding, snap-fitting, etc.).

In an embodiment of the present invention, diameter d of rotationally symmetric section 8" of displacement member 8 is equal, or approximately equal, to the opening diameter of blower 5, which is designated c. By matching the distances designated a and b to the geometry of flow chamber 7 and to the opening diameter c of blower 5 and to diameter d of displacement member 8, a constant flow area is obtained. The velocity field of the air flow can be adjusted via the parameters a and b.

Depending on the geometric configuration of the flow chamber, the displacement member may also be positioned on an axis inclined to the blower axis.

LIST OF REFERENCE NUMERALS

1 laundry dryer
2 drum
3 loading opening
4 functional component (filling ring)
5 blower
6 air duct
7 flow chamber
8 displacement member
  8' spherical section
  8" cylindrical section
9 blower axis
10 face area
11 wall section

What is claimed is:

1. A laundry dryer comprising;

a drum;

a blower including an opening;

an air duct configured to convey a flow of air from the drum to the blower, the air duct including at least one flow chamber, the at least one flow chamber including a wall section opposite the opening of the blower and curved sections, the at least one flow chamber being configured to deflect the flow of air toward the blower; and a displacement member disposed in the at least one flow chamber and extending toward the opening of the blower from the wall section opposite the opening of the blower, the displacement member including a cylindrical section having a diameter substantially equal to a diameter of the opening of the blower and a spherical section adjacent to the cylindrical section, the displacement member being configured to produce an irrotational flow onto the blower so as to reduce a formation of vortices.

2. The laundry dryer as recited in claim 1 wherein the displacement member is disposed on an axis of the blower.

3. The laundry dryer as recited in claim 2 wherein the displacement member is integral with the wall section of the flow chamber that is opposite the opening of the blower.

4. The laundry dryer as recited in claim 1 wherein the displacement member is disposed axially parallel to an axis of the blower.

5. The laundry dryer as recited in claim 4 wherein the displacement member is integral with the wall section of the flow chamber that is opposite the opening of the blower.

6. The laundry dryer as recited in claim 1 wherein the displacement member is integral with the wall section of the flow chamber that is opposite the opening of the blower.

* * * * *